US008119584B2

(12) United States Patent
Harthun et al.

(10) Patent No.: US 8,119,584 B2
(45) Date of Patent: Feb. 21, 2012

(54) UNIVERSAL AQUEOUS CLEANING SOLUTION FOR ELECTRIC SHAVERS

(75) Inventors: Richard A. Harthun, Eagle, WI (US); David W. Everett, Verona, WI (US); Giovanni Gonzalez, Sun Prairie, WI (US)

(73) Assignee: Rovcal, Inc., Madison, WI (US)

( * ) Notice: Subject to any disclaimer, the term of this patent is extended or adjusted under 35 U.S.C. 154(b) by 0 days.

(21) Appl. No.: 12/839,128

(22) Filed: Jul. 19, 2010

(65) Prior Publication Data

US 2012/0015856 A1 Jan. 19, 2012

(51) Int. Cl.
*C11D 1/94* (2006.01)
*C11D 3/44* (2006.01)

(52) U.S. Cl. ..... 510/161; 510/181; 510/182; 510/245; 510/426; 510/427; 510/432; 510/490

(58) Field of Classification Search ..... 510/161, 510/182, 181, 245, 426, 427, 432, 490; 30/41
See application file for complete search history.

(56) References Cited

U.S. PATENT DOCUMENTS

| | | | | |
|---|---|---|---|---|
| 2,349,183 | A | 5/1944 | Mahler | |
| 6,006,760 | A | 12/1999 | Benzinger | |
| 6,014,975 | A | 1/2000 | Benzinger | |
| 6,257,247 | B1 | 7/2001 | Benzinger | |
| 6,626,194 | B2 * | 9/2003 | Wong | 134/102.2 |
| 6,846,492 | B2 * | 1/2005 | Haap et al. | 424/405 |
| 2003/0147822 | A1 * | 8/2003 | Doi et al. | 424/70.1 |
| 2004/0091441 | A1 * | 5/2004 | Heike et al. | 424/70.13 |
| 2005/0245422 | A1 | 11/2005 | Yamada et al. | |
| 2006/0034793 | A1 * | 2/2006 | Yerby et al. | 424/70.16 |
| 2006/0100115 | A1 * | 5/2006 | Sakurai et al. | 510/127 |
| 2006/0225285 | A1 * | 10/2006 | Slavtcheff et al. | 30/41 |
| 2006/0285995 | A1 | 12/2006 | Hobbs et al. | |
| 2007/0241306 | A1 * | 10/2007 | Wehner et al. | 252/67 |
| 2008/0092930 | A1 | 4/2008 | Brinkert et al. | |
| 2009/0031566 | A1 | 2/2009 | Kitamura | |
| 2010/0197549 | A1 * | 8/2010 | Bettiol et al. | 510/236 |
| 2010/0197554 | A1 * | 8/2010 | Koyuncu et al. | 510/236 |
| 2010/0243008 | A1 * | 9/2010 | Schmitt | 134/136 |

FOREIGN PATENT DOCUMENTS

| | | | |
|---|---|---|---|
| DE | 10221335 | A1 | 11/2003 |
| WO | 02080864 | A1 | 10/2002 |
| WO | 2005042828 | A2 | 5/2005 |
| WO | 2006109242 | A1 | 10/2006 |
| WO | 2007028446 | A1 | 3/2007 |

OTHER PUBLICATIONS

Extended European Search Report issued for European Application No. 11250651.4-2114 (mailed on Nov. 22, 2011).

* cited by examiner

*Primary Examiner* — Charles Boyer
(74) *Attorney, Agent, or Firm* — Armstrong Teasdale LLP

(57) ABSTRACT

The present disclosure generally relates to a method for cleaning a shaving device using a cleaning solution and preparation of the cleaning solution. More particularly, the present disclosure relates to a method of cleaning a shaving device using an environmentally friendly cleaning solution.

9 Claims, 2 Drawing Sheets

UNIVERSAL AQUEOUS CLEANING SOLUTION FOR ELECTRIC SHAVERS

FIELD OF THE DISCLOSURE

The present disclosure generally relates to a method for cleaning a shaving device using a cleaning solution and preparation of the cleaning solution. More particularly, the present disclosure relates to a method of cleaning a shaving device using an environmentally friendly cleaning solution.

BACKGROUND OF THE DISCLOSURE

Shaving devices have been known to exhibit optimum cutting effectiveness when the shaver head components move freely. As such, cleaning the shaver head on a regular basis is often recommended to facilitate smooth operation of the shaver head components. However, routine cleaning can be time-consuming and is often avoided, resulting in a buildup of debris inside the shaver head. Because debris buildup in the shaver head can inhibit movement of the shaver head components, failing to regularly clean the shaver head tends to detract from the cutting effectiveness of the shaver head, which could lead to a less than desirable shaving experience.

It is also important, when cleaning a shaving device, to use a cleaning solution that comprises antimicrobial and hypoallergenic properties. In the past, cleaning solutions comprised a variety of components to this effect, but included components that were derived from non-renewable resources.

With global climate change concerns becoming a significant social issue, there is a growing movement of environmental consciousness. Specifically, consumers are becoming more aware of how their daily choices affect the environment. In particular, consumers are becoming increasingly concerned about how energy production using non-renewable resources impacts the environment, and, in turn, the future quality of life.

There is a need, therefore, for an environmentally friendly cleaning solution for shaving devices that also has antimicrobial and hypoallergenic properties.

SUMMARY OF THE DISCLOSURE

Briefly, therefore, the present disclosure is directed to a method for cleaning a shaving device. The device comprises a cutting surface for removing hair from skin or a hide. The method comprises at least partially contacting the cutting surface with a cleaning solution. The cleaning solution comprises water, an alcohol derived from a renewable source, a polyol and a surfactant system. The surfactant system comprises an anionic surfactant and an amphoteric surfactant.

The present disclosure is further directed to a method for preparing a cleaning solution for cleaning a shaving device. The method comprises providing an alcohol derived from a renewable source and combining the alcohol with water, a polyol and a surfactant system. The surfactant system comprises an anionic surfactant and an amphoteric surfactant.

The present disclosure is still further directed to a liquid composition for cleaning a shaving device. The liquid composition comprises water, an alcohol derived from a renewable source, a polyol and a surfactant system. The surfactant system comprises an anionic surfactant and an amphoteric surfactant.

BRIEF DESCRIPTION OF THE DRAWINGS

It is to be noted that corresponding reference characters indicate corresponding parts throughout the several views of the drawings.

Figure 1:
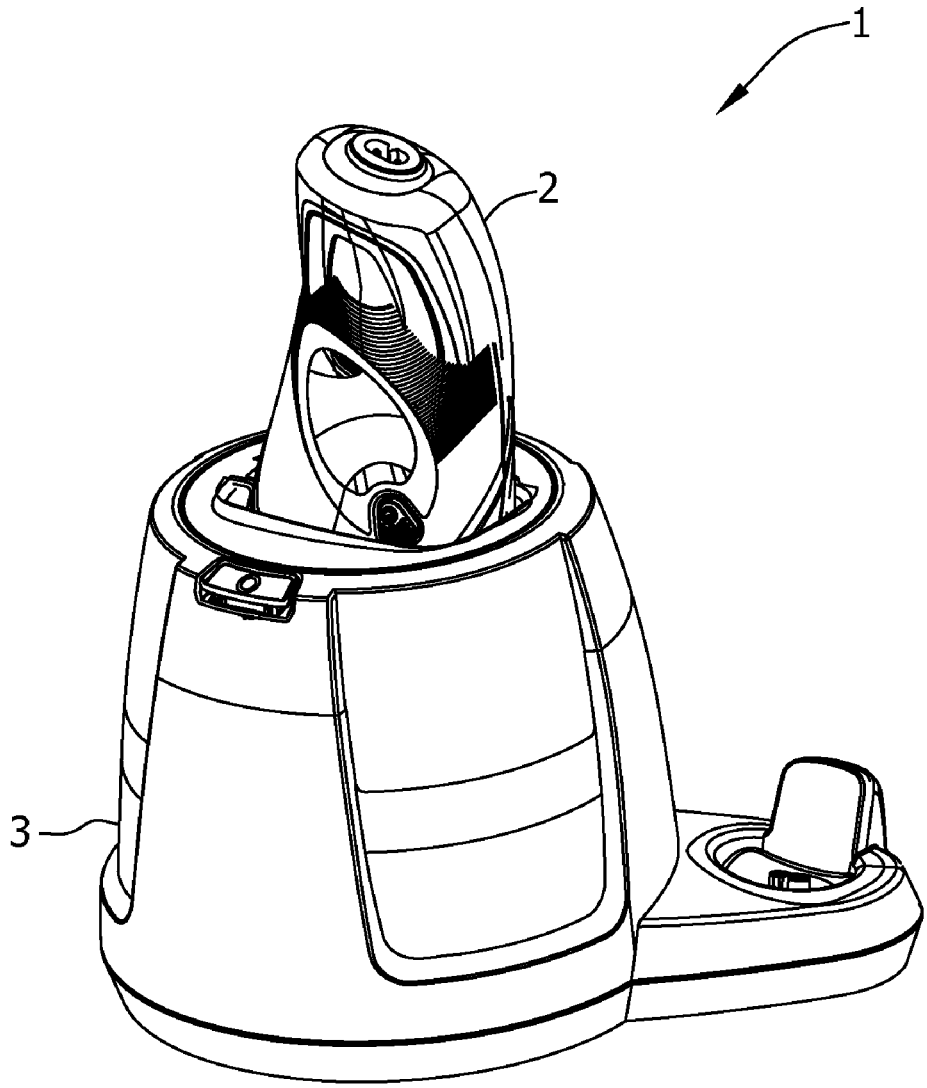
FIG. 1 depicts an exemplary embodiment of a cleaning system according to the present disclosure.

It is to be further noted that the design or configuration of the components presented in these figures are not to scale, and/or are intended for purposes of illustration only. Accordingly, the design or configuration of the components may be other than herein described without departing from the intended scope of the present disclosure. These figures should therefore not be viewed in a limiting sense.

DETAILED DESCRIPTION OF THE DISCLOSURE

In accordance with the present disclosure, a cleaning solution has been discovered that is designed to work on personal care devices (e.g., a shaving device, and more specifically an electric shaver), the solution having "green" compliance, an antimicrobial property and/or a hypoallergenic property. In one embodiment of the present disclosure, the cleaning solution may be used with essentially all commercially available shaver cleaning systems.

Specifically, it has been discovered that an environmentally friendly liquid composition that comprises water, an alcohol derived from a renewable source, a polyol and a surfactant system comprising an anionic surfactant and an amphoteric surfactant can be used to clean personal care devices.

A. Terms

It is to be noted that as used herein, the following terms or phrases, or variations thereof, generally have the following meanings.

The term "green", as used herein, generally refers to items that are beneficial to the environment.

The phrase "environmentally friendly" generally refers to an item that either has a positive or neutral effect on the environment. That is, an item is environmentally friendly if it does not negatively impact the environment.

The term "shaving device" generally refers to a device, such as a personal care device or a hair styling device, used to trim or groom hair. The term includes devices that groom (e.g., cut) hair while making contact with skin surfaces, such as an electric shaver.

The term "cleaning solution" generally refers to the liquid composition that is used to clean the shaving devices described herein.

The term "renewable source" generally refers to a source that is replaced by natural processes at a rate comparable or faster than its rate of consumption. For example, in the use of an alcohol, such as ethanol, it is derived from a non-petroleum source, such as a plant-based renewable feedstock (e.g., corn).

B. Liquid Cleaning Solution

In one embodiment of the present disclosure, a liquid composition for cleaning a shaving device is disclosed. The liquid composition can be used as a cleaning solution and comprises water, an alcohol derived from a renewable source, a polyol and a surfactant system comprising an anionic surfactant and an amphoteric surfactant.

Water can be present in the liquid composition in an amount from about 90 to about 98% by weight and preferably at about 95% by weight of the liquid composition. Preferably, the water in the liquid composition is deionized water that is substantially free of contaminating elements. That is, the deionized water is preferably clear, colorless, lacks turbidity and is substantially free of any particulates or foreign matter, such as sand, polymer particulates and pipe scale. In a preferred embodiment, if any such particulates are present, they are present in an amount of less than about 0.1% by weight of the deionized water. In a preferred embodiment, the total ion content (as directly measured by resistivity) is greater than or equal to about 10 MΩ/cm at 25° C. (e.g., about 15 MΩ/cm, about 20 MΩ/cm or more) and the bacteria content limit is less than 20 colony forming units per milliliter (cfu/ml) (e.g., about 15 cfu/ml, about 10 cfu/ml, or less). Preferably, the acidity/alkalinity of the deionized water is in the pH range from about 5.0 to about 7.0 at 25° C. or from about 5.5 to about 7.0 at 25° C. and the water is odorless. Using deionized water helps to achieve the desired antimicrobial and hypoallergenic effects.

The alcohol in the liquid composition can be present in an amount from about 1 to about 10% by weight, preferably from about 1 to about 5% by weight, and more preferably at about 3% by weight of the liquid composition. The alcohol is used in the present disclosure as an additive that enhances the cleaning efficiency of the solution. In a preferred embodiment of the present disclosure, the alcohol is derived from a renewable source. Suitable renewable sources include plant-based renewable feedstock. That is, the alcohol is not derived from petroleum, but, rather, the alcohol is derived from a plant. The plant sources can include corn and various grains. By using an alcohol derived from a renewable source, the cleaning solution of the present disclosure is recognized in the art as being environmentally friendly. In a preferred embodiment of the present disclosure, the alcohol in the liquid composition is ethanol.

The polyol in the liquid composition can be present in an amount from about 0.05% to about 1% by weight, preferably at about 0.1% by weight of the liquid composition. The polyol can be derived from various sources known in the art, as long as the polyol does not depart from the embodiments of the present disclosure. The polyol in the present disclosure acts as a cosmetic product additive that functions as a bacteriostat and an emulsifying agent. The polyol exhibits a high degree of component penetration and can act as a skin lubricant or as a humectant to reduce skin irritation. In a preferred embodiment of the present disclosure, the polyol is glycerol.

The liquid composition also comprises a surfactant system comprising an anionic surfactant and an amphoteric surfactant. In a preferred embodiment of the present disclosure, the anionic surfactant and the amphoteric surfactant are present in the liquid composition at a ratio of about 1:1, more preferably at a ratio of about 1:2, and even more preferably at a ratio of about 1:1.6.

The anionic surfactant can be present in the liquid composition in an amount from about 0.05% to about 1% by weight, preferably from about 0.1% to about 0.5% by weight and more preferably at about 0.3% by weight of the liquid composition. The anionic surfactant functions as a low-foaming organic structure and as a solubilizer. In a preferred embodiment of the present disclosure, the anionic surfactant is sodium-n-octyl sulfate. An example of a suitable anionic surfactant of the present disclosure is Texapon® 842 (made by Cognis Corporation, 5051 Estecreek Drive, Cincinnati, Ohio, 45232-1446).

The amphoteric surfactant can be present in the liquid composition in an amount from about 0.05 to about 1% by weight and preferably at about 0.5% by weight of the liquid composition. The amphoteric surfactant functions to inhibit corrosion of the shaving device. For instance, the amphoteric surfactant of the present disclosure inhibits corrosion for aluminum, stainless steel and mild steel alloys. The amphoteric surfactant exhibits a high solubility over a wide range of pH measurements for the liquid composition. In a preferred embodiment of the present disclosure, the amphoteric surfactant is sodium lauriminodipropionate. An example of a suitable amphoteric surfactant of the present disclosure is Deriphat® 160C (made by Cognis Corporation, 5051 Estecreek Drive, Cincinnati, Ohio, 45232-1446).

In a preferred embodiment of the present disclosure, the liquid composition further comprises a defoaming agent surfactant. The defoaming agent surfactant can be present in the liquid composition from about 0.01% to about 0.25% by weight and preferably at about 0.10% by weight of the liquid composition. In a preferred embodiment of the present disclosure, the defoaming agent surfactant is a mixed ethoxylated/propoxylated aliphatic alcohol. An example of a suitable defoaming agent surfactant in accordance with the present disclosure is Dehyphon® LS 36 (made by Cognis Corporation, 5051 Estecreek Drive, Cincinnati, Ohio, 45232-1446). The defoaming agent surfactant can have biodegradable properties and works in conjunction with the surfactant system and neutralizes any excessive foaming that might occur from the anionic surfactant.

The liquid composition can further comprise an additive selected from the group consisting of an antimicrobial agent, a fragrance, a colorant, a pH balancer and combinations thereof.

In a preferred embodiment of the present disclosure, the liquid composition comprises an antimicrobial agent in an amount from about 0.05% to about 0.5% by weight, preferably from about 0.05% to about 0.2% by weight and more preferably at about 0.1% by weight of the liquid composition. The antimicrobial agent allows the liquid composition to inhibit bacterial growth. In a preferred embodiment of the present disclosure, the antimicrobial agent is a broad spectrum biocide and is free of formaldehyde. The antimicrobial agent can be highly soluble in water and selective alcohols, such as ethanol. The antimicrobial agent of the present disclosure can be effective at a wide pH range (i.e., from about 2 to about 12) and at various temperatures. The antimicrobial agent of the present disclosure is compatible with a wide variety of surfactants. In a preferred embodiment of the present disclosure, the antimicrobial agent is methylisothiazolinone. A suitable antimicrobial agent of a preferred embodiment of the present disclosure is Neolone® M-10 (made by the Rohm and Haas Company, 100 Independence Mall West, Philadelphia, Pa., 19106-2399).

In another preferred embodiment of the present disclosure, the liquid composition further comprises a fragrance. The fragrance can be present in an amount from about 0.05% to about 0.5% by weight, preferably from about 0.1% to about 0.3% by weight and more preferably at about 0.2% by weight of the liquid composition. The fragrance can be added to the liquid composition to enhance the aroma of the composition. Suitable fragrances include those known in the art, so long as their inclusion does not depart from the scope of the present disclosure. In a preferred embodiment of the present disclosure, the fragrance is a citrus fragrance derived from a natural/plant based origin, preferably naturally formulated Citrus Fragrance 328-261 (made by Alpine Aromatics International Incorporated, 51 Ethel Road West, Piscataway, N.J. 08854-5928).

In a preferred embodiment of the present disclosure, the liquid composition further comprises a colorant. The colorant can be present in the liquid composition in an amount to provide a tincture of color that can be measured at Pantone® 312C at 25 mm. The colorant functions to change the appearance of the liquid composition to a color that is aesthetically pleasing to an individual. Suitable colorants include those known in the art, so long as their inclusion does not depart from the scope of the present disclosure. In a preferred embodiment of the present disclosure, the colorant is FD&C Blue #1 Solution Colorant, which is available from various sources known in the art.

In a preferred embodiment of the present disclosure, the liquid composition further comprises a pH balancer. The pH balancer can be present in the liquid composition in amounts sufficient to adjust the pH of the liquid composition to about 6.5+/−0.05. Suitable pH balancers include those known in the art, so long as their inclusion does not depart from the scope of the present disclosure. In a preferred embodiment of the present disclosure, the pH balancer is a naturally derived additive that is a natural anti-oxidant and preservative. A suitable pH balancer in accordance with the present disclosure is, for example, citric acid (e.g., added in the form of about a 5 weight % solution in deionized water).

In yet another embodiment of the present disclosure, the components in the liquid composition are selected so that the composition comprises a Solution Carbon Index of about 95% or greater (e.g., about 95%, about 96%, about 97%, about 98%, or about 99%). The Carbon Index value is an industry-wide standard that is calculated by the percentage of carbon atoms inherent to the liquid composition that originate from renewable, natural plant resources and does not include carbon atoms present from mineral (i.e., petroleum-based) sources. That is, the percent carbon atoms originating from renewable, natural sources is about 95% (excluding, if applicable, the naturally derived fragrance and pH balancer). In this embodiment, the liquid composition is an environmentally friendly cleaning solution.

C. Method for Preparing a Cleaning Solution

In another embodiment of the present disclosure, a method for preparing a cleaning solution for cleaning a shaving device is disclosed. The method comprises providing an alcohol derived from a renewable source and combining the alcohol with water, a polyol and a surfactant system comprising an anionic surfactant and an amphoteric surfactant.

In a preferred embodiment of the present disclosure, the cleaning solution comprises the same components, concentration ranges and preferred embodiments as the liquid composition described elsewhere throughout this application. In particular, in a preferred embodiment of the present disclosure, the cleaning solution has a carbon index of at least about 95%.

D. Method for Cleaning a Shaving Device

In an alternative embodiment, a method for cleaning a shaving device is disclosed. The device comprises a cutting surface for removing hair from skin or a hide. The method comprises contacting the cutting surface with a cleaning solution comprising water, an alcohol, a polyol and a surfactant system comprising an anionic surfactant and an amphoteric surfactant. In a preferred embodiment of the present disclosure, contacting the cutting surface with a cleaning solution comprises at least partially submerging the cutting surface in the cleaning solution.

In a preferred embodiment of the present disclosure, the cleaning solution comprises the same components, concentration ranges and preferred embodiments as the liquid composition described elsewhere throughout this application.

FIG. 1 discloses an illustrated embodiment of the present disclosure. Specifically, FIG. 1 discloses a cleaning system 1 in accordance with the method of present disclosure. The cleaning system 1 includes a shaving device 2 that can be placed in a reservoir 3. The reservoir 3 comprises the cleaning solution of the present disclosure. It is to be noted that any device known in the art (e.g., cup, container, etc.) may be used to hold the cleaning solution, so long as the device holding the cleaning solution does not depart from the scope of the present disclosure.

Figure 2:
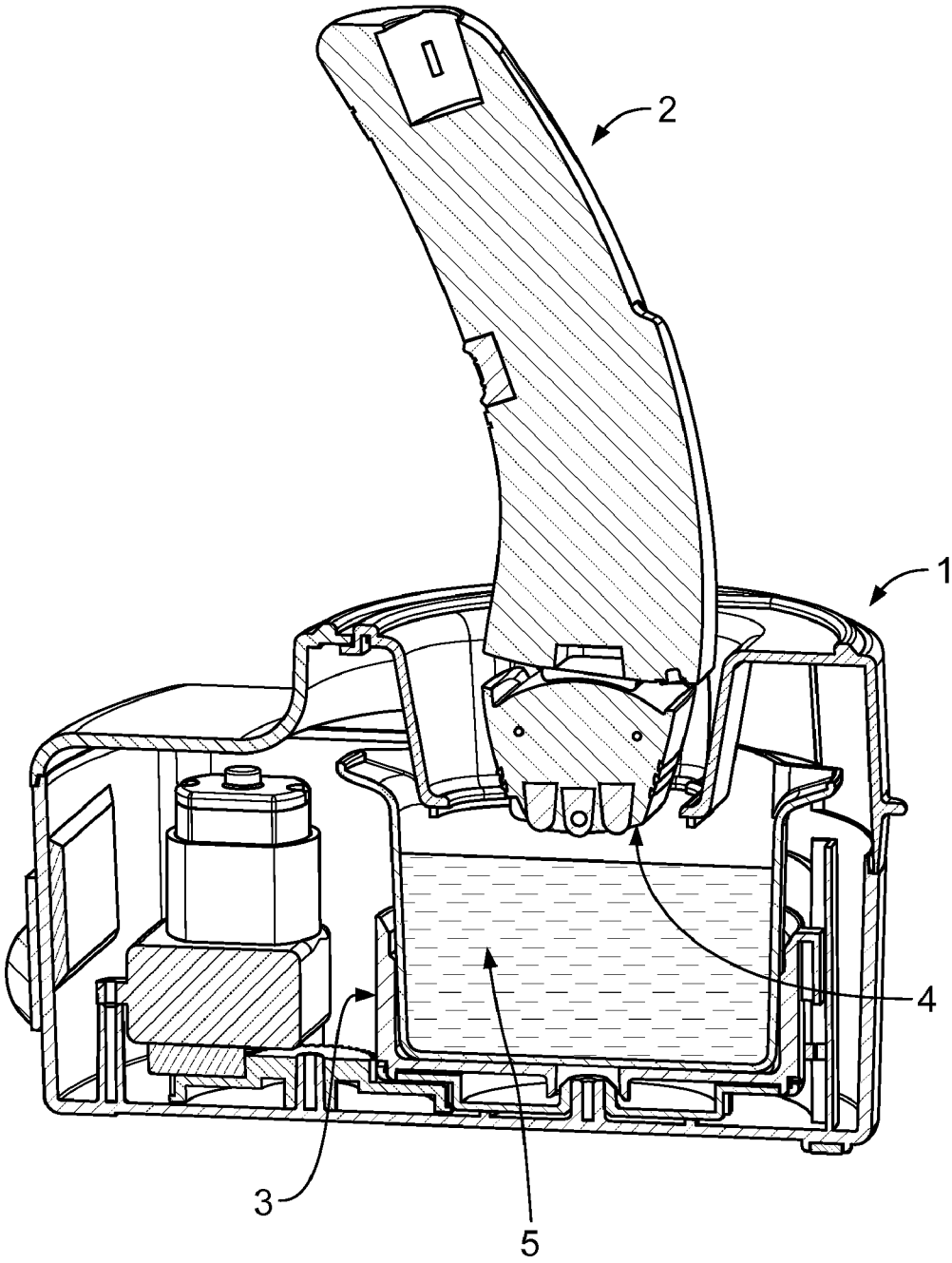
FIG. 2 depicts a perspective view of an exemplary embodiment of a cleaning system according to the present disclosure.

FIG. 2 discloses another illustrated embodiment of the present disclosure. In a preferred operation, a user fills the reservoir 3 with the cleaning solution 5 of the present disclosure. The user then places the shaving device 2 in the cleaning system 1 so as to at least partially submerge the cutting surface 4 of the shaving device 2 in the cleaning solution 5, which is held by the reservoir 3.

The user can then leave the cutting surface 4 of the shaving device 2 at least partially submerged in the cleaning solution 5 (located in the reservoir 3) for a desired period of time to obtain a given level of cleanliness. After the desired period of time elapses, the user removes the shaving device 2 from the cleaning system 1 and then can proceed to perform shaving of the user's hair and obtain the benefits of the cleaning solution 5. The user may repeat the cleaning operation to achieve any desired level of cleanliness. In a preferred embodiment of the present disclosure, the user will leave the cutting surface 4 of the shaving device 2 at least partially submerged in the cleaning solution 5 for about 4 to about 5 minutes, preferably for about 4.5 minutes.

It is to be noted that in all of the exemplary embodiments and disclosures discussed above, the present disclosure is able to be used on both humans and animals.

The following Examples describe various embodiments of the present disclosure. Other embodiments within the scope of the appended claims will be apparent to a skilled artisan considering the specification or practice of the disclosure as described herein. It is intended that the specification, together with the Examples, be considered exemplary only, with the scope and spirit of the disclosure being indicated by the claims, which follow the Examples.

EXAMPLES

The following non-limiting examples are provided to further illustrate the present disclosure.

Example 1

Carbon Index of Cleaning Solution

The following example illustrates a preferred embodiment of the liquid cleaning solution. Specifically, the following example illustrates the calculations used to determine the Carbon Index of a preferred embodiment of the liquid composition. The Carbon Index of the following example is about 95%.

TABLE 1

| Formulation Component | Percent Weight | Component, Percent Active | Formula, Percent Active | Component, Carbon Index | Formula, Carbon Index |
|---|---|---|---|---|---|
| Deionized Water | 94.88 | — | — | — | — |
| Ethanol | 3.80 | 100 | 3.800 | 100 | 0.126 |
| Texapon ® 842 | 0.30 | 42 | 0.126 | 100 | 0.126 |
| Deriphat ® 160C | 0.50 | 30 | 0.150 | 66 | 0.099 |
| Dehyphon ® LS 36 | 0.10 | 100 | 0.100 | 35 | 0.035 |
| Neolone ® M-10 | 0.12 | 100 | 0.120 | 0 | 0 |
| Glycerol | 0.10 | 99 | 0.297 | 100 | 0.297 |
| Fragrance | 0.20 | 100 | 0.200 | 100 | 0.200 |
| FD & C Blue #1 | Tincture | — | — | — | — |
| Citric Acid | Tincture | — | — | — | — |
| Totals | 100 | — | 4.79 | — | 4.56 |

Example 2

Cleaning Solution Antimicrobial Efficacy

In accordance with the present disclosure, the cleaning solution is not only environmentally friendly but also can possess antimicrobial properties. The cleaning solution disclosed in Example 1 was tested for both neutralizer efficacy and time kill of bacteria.

The testing procedures for this example were based upon ASTM E 2315-03 (2008), Standard Guide for Assessment of Antimicrobial Activity Using a Time Kill Procedure. The neutralizer efficacy procedure was based upon USP <61> Microbial Limit Tests: Preparatory Testing, Current Edition. The test organisms used for this example were *Staphylococcus aureus* (ATCC 6538), *Escherichia coli* (ATCC 8739) and *Pseudomonas aeruginosa* (ATCC 9027).

For the neutralizer efficacy test, an inoculum of each test organism was prepared at approximately $1.0\times10^4$ cfu/ml in saline. Then, 0.1 ml of this inoculum was added to 9 ml of the test product diluted 1 in 10 and 1 in 100 in appropriate neutralizer. Any duplicate 1 ml aliquots were plated. The inoculum counts were calculated by adding 0.1 ml of the $1.0\times10^4$ inoculum to 9 ml of diluent and any duplicate 1 ml aliquots were plated.

For the time kill test, an inoculum of each test organism was prepared at approximately $1.0\times10^8$ cfu/ml in saline. A pool was then made by combining equal volumes of each suspension. The pool was then inoculated at a level of 0.5 ml per 10 ml aliquots of product to achieve a concentration of approximately $5.0\times10^6$ cfu/ml product. The inoculated product was then stored at room temperature for the duration of the test. 1 ml samples were removed for plating at days 3, 5 and 14.

The neutralizer efficacy and time kill tests were run on a preferred embodiment of the cleaning solution of the present disclosure, as well as on two separate competitor personal care devices. The results of the tests are shown in Tables 2 and 3.

TABLE 2

Time Kill Test

| Product | Inoculum (cfu/ml) | Day 3 (cfu/ml) | Log Red. | Day 5 (cfu/ml) | Log Red. | Day 14 (cfu/ml) | Log Red. |
|---|---|---|---|---|---|---|---|
| Remington | $5.0\times10^6$ | <10 | >5.7 | <10 | >5.7 | <10 | >5.7 |
| Commercial #1 | $5.0\times10^6$ | <10 | >5.7 | <10 | >5.7 | <10 | >5.7 |
| Commercial #2 | $5.0\times10^6$ | <10 | >5.7 | <10 | >5.7 | <10 | >5.7 |

As shown in Table 2, the number of viable organisms within the inoculated products was reduced to less than a detectable level by the third day, which was the earliest point of the testing period. As further shown in Table 2, the cleaning solution of the present disclosure performed just as effectively on two different commercial personal care devices as it did on the personal care device in accordance with the present disclosure. That is, in all instances, the cleaning solution of the present disclosure killed enough bacteria to establish a baseline count of bacteria of less than 10 cfu/ml.

TABLE 3

Neutralizer Efficacy

| Remington | Inoculum | Inoculum counts (cfu/ml) | Sample 1:10 (cfu/ml) | % recovery | Sample 1:100 (cfu/ml) | % recovery |
|---|---|---|---|---|---|---|
| | *S. aureus* | 84 | 94 | 112 | 110 | 131 |
| | *E. coli* | 177 | 141 | 80 | 131 | 74 |
| | *P. aeruginosa* | 76 | 66 | 87 | 76 | 100 |
| **Commercial #1** | **Inoculum** | **Inoculum counts (cfu/ml)** | **Sample 1:10 (cfu/ml)** | **% recovery** | **Sample 1:100 (cfu/ml)** | **% recovery** |
| | *S. aureus* | 84 | 98 | 117 | 98 | 117 |
| | *E. coli* | 177 | 125 | 71 | 117 | 66 |
| | *P. aeruginosa* | 76 | 84 | 111 | 75 | 99 |
| **Commercial #2** | **Inoculum** | **Inoculum counts (cfu/ml)** | **Sample 1:10 (cfu/ml)** | **% recovery** | **Sample 1:100 (cfu/ml)** | **% recovery** |
| | *S. aureus* | 84 | 102 | 121 | 118 | 140 |
| | *E. coli* | 177 | 153 | 86 | 174 | 98 |
| | *P. aeruginosa* | 76 | 79 | 104 | 84 | 111 |

As shown in Table 3, each product was effectively neutralized by the cleaning solution at a 1 in 10 dilution, which enables the recovery of any viable organisms.

Example 3

Skin Irritation/Sensitization Evaluation

The cleaning solution of Example 1 was tested to determine the irritation and sensitization potential after repeated application to the skin of human subjects.

The cleaning solution that was tested under occlusive conditions was placed on an 8-millimeter aluminum chamber (Finn Chamber, Epitest Ltd. Oy, Tuussula, Finland) supported on a sheet of Scanpore® (occlusive) tape (Norgesplaster A/S, Kristiansand, Norway) or an equivalent known in the art.

The cleaning solution that was tested under semi-occlusive conditions was placed on Curad™ sensitive skin bandages.

The cleaning solution to be tested in an open patch was applied and rubbed directly onto the back of the human subject.

Approximately 0.02-0.05 ml of the cleaning solution was used for this example. The cleaning solution was dispensed on a 7.5 mm paper disk, which fit in the Finn Chamber.

In this example, the human subjects bathed or washed as usual prior to arrival at the testing facility. Patches containing the cleaning solution were then affixed directly to the skin of the intrascapular regions of the back, to the right or left of the midline and the subjects were dismissed with instructions not to wet or expose the test area to direct sunlight.

The subjects removed the patches approximately 48 hours after the first application and 24 hours thereafter for the remainder of the study. This procedure was repeated until a series of 9 consecutive, 24-hour exposures had been made 3 times a week for 3 consecutive weeks. Prior to each reapplication, the test sites were evaluated by trained laboratory personnel.

Following a 10-14 day rest period, a retest/challenge dose was applied once to a previously unexposed test site. Test sites were then evaluated 48 and 96 hours after application.

The following scoring scale was established: 0-no reaction; 1—erythema throughout at least ¾ of patch area; 2—erythema and induration throughout at lest ¾ of patch area; 3—erythema, induration and vesicles; 4-erythema, induration and bullae; D—site discontinued; and Dc—subject discontinued.

58 subjects of various ages and sex were tested. Of the 58 subjects, no adverse reactions of any kind were reported. That is, all 58 subjects reported a score of "0" at each induction time. The study showed that there were no identifiable signs or symptoms of primary irritation or sensitization (contact allergy) for the cleaning solution of the present disclosure.

Example 4

Evaluation of Tensile Properties of Personal Care Devices Following Exposure to the Cleaning Solution The tensile properties of personal care devices were measured following exposure of the personal care devices to the cleaning solution of Example 1. Four ASTM D 638 Type II tensile specimens were provided by Stork Technimet from an internal supply for this study. The specimens had been molded from an unspecified grade of acrylonitrile-butadiene-styrene (ABS) resin and baseline tensile data was available from specimens from the same original production run.

The set of tensile specimens was submerged in the cleaning solution for a period of 26.2 days at a temperature of 50° C. The tensile properties of the specimens were determined upon completion of the exposure period and compared to the baseline values.

During accelerated exposure tests, the set of tensile specimens was fully immersed in the cleaning solution within a sealed glass jar in order to prevent evaporation of the cleaning solution. The specimens were then placed into an air circulating laboratory oven at a nominal 50° C. for a period of 26.2 days and examined periodically. The 26.2 day timeframe was selected in order to emulate periodic exposure of parts made from a similar resin to the cleaning solution for the full duration of its anticipated life cycle (approximately 2 years). At the completion of the 26.2 days, the tensile specimens were removed from the jars, rinsed with deionized water, and inspected. No evidence of discoloration, cracking, or deterioration was observed upon visual inspection of the tensile specimens.

Tensile testing of the specimens was then performed on an MTS universal tester in accordance with ASTM D 638-08. Upon completion of the exposure period, but prior to evaluation, the tensile specimens were prepared and allowed to condition for a minimum period of 40 hours at 23° C. and 50% relative humidity. The specimens were then tested at ambient laboratory conditions on an MTS universal tester using a 500 pound load cell with a constant speed of 2.0 inches per minute. The extension was then measured using a standard 2 inch contacting extensometer.

The detailed results are indicated in Tables 4-6.

TABLE 4

Baseline Values of ABS Specimens

| Specimen # | Width (in.) | Thickness (in.) | Yield Stress (psi) | Elongation at Yield (%) | Modulus (ksi) | Tensile Stress at Break (psi) | Elongation at Break (%) |
|---|---|---|---|---|---|---|---|
| 1 | 0.498 | 0.125 | 6367.3 | 2.48 | 331.4 | 4931 | 22.90 |
| 2 | 0.496 | 0.125 | 6331.9 | 2.46 | 334.2 | 5003 | 19.56 |
| 3 | 0.498 | 0.126 | 6352.0 | 2.48 | 330.8 | 5030 | 22.12 |
| Mean | 0.497 | 0.125 | 6350.4 | 2.47 | 332.1 | 4988 | 21.53 |
| Std. Dev. | 0.001 | 0.001 | 17.8 | 0.01 | 1.8 | 51 | 1.75 |

TABLE 5

ABS Specimens Following Cleaning Solution Exposure

| Specimen # | Width (in.) | Thickness (in.) | Yield Stress (psi) | Elongation at Yield (%) | Modulus (ksi) | Tensile Stress at Break (psi) | Elongation at Break (%) |
|---|---|---|---|---|---|---|---|
| 1 | 0.496 | 0.126 | 6403.3 | 2.40 | 331.4 | 4992 | 26.87 |
| 2 | 0.496 | 0.126 | 6320.0 | 2.42 | 327.6 | 4928 | 27.41 |
| 3 | 0.496 | 0.126 | 6359.9 | 2.40 | 327.8 | 5033 | 26.60 |
| 4 | 0.495 | 0.126 | 6317.8 | 2.41 | 327.9 | 4839 | 26.03 |

TABLE 5-continued

| ABS Specimens Following Cleaning Solution Exposure | | | | | | | |
|---|---|---|---|---|---|---|---|
| Specimen # | Width (in.) | Thickness (in.) | Yield Stress (psi) | Elongation at Yield (%) | Modulus (ksi) | Tensile Stress at Break (psi) | Elongation at Break (%) |
| Mean | 0.496 | 0.126 | 6350.2 | 2.41 | 328.7 | 4948 | 26.73 |
| Std. Dev. | 0.001 | 0.000 | 40.3 | 0.01 | 1.8 | 85 | 0.57 |

TABLE 6

| Tensile Test Results | | | | |
|---|---|---|---|---|
| Specimen | As-Molded ABS Specimens | ABS Specimens Following Exposure | % Change | Max Allowable |
| Tensile Strength at Yield, psi | 6,350 (18) | 6,350 (40) | 0.0 | −25% |
| Elongation at Yield, % | 2.41 (0.01) | 2.41 (0.01) | +2.5 | −25% |
| Modulus, ksi | 332 (1.8) | 329 (1.8) | +0.9 | −25% |
| Tensile Stress at Break, psi | 4,990 (51) | 4,950 (85) | +0.8 | −25% |
| Elongation at Break, % | 21.5 (1.8) | 26.7 (0.6) | −19.5 | −25% |

The results in Table 6 reveal that the set of tensile specimens which had undergone the exposure to the cleaning solution produced results almost identical to the baseline values (Table 6 discloses the averages of 3 or 4 specimens with the standard deviations provided in parentheses). Specifically, the variation in tensile strength at yield and break, elongation at yield, and tensile modulus values did not vary by more than 3% from the baseline. The elongation at break value, however, was the only aberrant result, having been measured at 19.5% lower than the baseline value. All of the values, however, were within the maximum decrease from baseline of 25%.

Accordingly, the cleaning solution of the present disclosure is environmentally friendly and does not negatively impact the tensile strength of the personal care devices upon which the cleaning solution is applied.

In view of the above, it will be seen that the several advantages of the disclosure are achieved and other advantageous results attained. As various changes could be made in the above processes and composites without departing from the scope of the disclosure, it is intended that all matter contained in the above description and shown in the accompanying drawings shall be interpreted as illustrative and not in a limiting sense.

When introducing elements of the present disclosure or the various versions, embodiment(s) or aspects thereof, the articles "a", "an", "the" and "said" are intended to mean that there are one or more of the elements. The terms "comprising", "including" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

What is claimed is:

1. A method for cleaning a shaving device, the device comprising a cutting surface for removing hair from skin or a hide, the method comprising contacting the cutting surface with a cleaning solution comprising water, ethanol derived from a renewable source, a polyol and a surfactant system comprising an anionic surfactant and an amphoteric surfactant, wherein the solution comprises from about 1% to about 10% by weight ethanol; from about 0.05% to about 1% by weight polyol; from about 0.05% to about 1% by weight anionic surfactant; and, from about 0.05% to about 1% by weight amphoteric surfactant.

2. The method as set forth in claim 1, wherein the surfactant system further comprises a defoaming agent surfactant.

3. The method as set forth in claim 2, wherein the defoaming agent surfactant is present in an amount from about 0.01% to about 0.25% by weight of the cleaning solution.

4. The method as set forth in claim 1, wherein the cleaning solution further comprises an additive selected from the group consisting of an antimicrobial agent, a fragrance, a colorant, a pH balancer and combinations thereof.

5. The method as set forth in claim 1, wherein the cleaning solution has a Carbon Index of at least about 95%.

6. A method for preparing a cleaning solution for cleaning a shaving device, the method comprising:

providing ethanol derived from a renewable source; and, combining the alcohol with water, a polyol and a surfactant system comprising an anionic surfactant and an amphoteric surfactant, wherein the solution comprises from about 1% to about 10% by weight ethanol; from about 0.05% to about 1% by weight polyol; from about 0.05% to about 1% by weight anionic surfactant; and, from about 0.05% to about 1% by weight amphoteric surfactant.

7. The method as set forth in claim 6, wherein the solution has a Carbon Index of at least about 95%.

8. The method as set forth in claim 6, wherein the surfactant system further comprises a defoaming agent surfactant.

9. The method as set forth in claim 6, wherein the solution further comprises an additive selected from the group consisting of an antimicrobial agent, a fragrance, a colorant, a pH balancer and combinations thereof.

* * * * *